US005195751A

United States Patent [19]

Senart

[11] Patent Number: 5,195,751

[45] Date of Patent: Mar. 23, 1993

[54] BOARD GAME WITH SPRAY NOZZLE

[76] Inventor: Joseph C. Senart, 19771 Meredith, Euclid, Ohio 44119

[21] Appl. No.: 795,769

[22] Filed: Nov. 21, 1991

[51] Int. Cl.[5] ..... A63B 67/00

[52] U.S. Cl. ..... 273/349; 273/236; 273/459

[58] Field of Search ..... 273/459, 349, 236

[56] References Cited

U.S. PATENT DOCUMENTS

| | | | |
|---|---|---|---|
| D. 311,034 | 10/1990 | LaRiviere . | |
| 1,389,162 | 8/1921 | Reed . | |
| 1,559,954 | 11/1925 | Gifford . | |
| 3,659,852 | 5/1972 | Redict . | |
| 3,734,508 | 5/1973 | Snyder . | |
| 4,040,622 | 8/1977 | Sinnot | 273/349 X |
| 4,113,259 | 9/1978 | Sands | 273/241 |
| 4,526,366 | 7/1985 | Kenoun . | |
| 4,813,680 | 3/1989 | Rudell et al. . | |

*Primary Examiner*—William H. Grieb

*Attorney, Agent, or Firm*—Fay, Sharpe, Beall, Fagan, Minnich & McKee

[57] ABSTRACT

A water board game apparatus includes a game board having a playing surface with a water ejection device or spray nozzle at the center thereof for ejecting water. The spray nozzle is operatively connected to the game board, which is water resistant. A first set of playing cards is provided for the game together with a second set of playing cards. Both sets of playing cards are water resistant and contain first indicia to differentiate the two sets of playing cards from each other and second indicia to differentiate among the playing cards in each set. The first set of playing cards has thereon a number indicating the number of times a player is to be sprayed with water. The second set of playing cards is used to construct a hand wherein the player having a higher hand wins and becomes the winning player for that round with the other player or players becoming the losers.

17 Claims, 1 Drawing Sheet

BOARD GAME WITH SPRAY NOZZLE

BACKGROUND OF THE INVENTION

The present invention relates generally to a game. More specifically, the present invention relates to a board game utilizing a water ejection nozzle and methods for playing a game with this apparatus.

While the development will be discussed in relation to a game board having a central opening in which is held a means for ejecting water, preferably a spray nozzle, it should be appreciated that the invention could also have numerous other embodiments as well.

While a host of games is generally available to the public, most such games are indoor games incapable of providing outdoor entertainment in the summer. Most of the outdoor games do not include the refreshing aspect of a spray of water, which delights children. There are a few outdoor water activity toys as well. However, these only offer unstructured non-rule, non-competitive play such as water slide toys or sprinklers that children can run through.

One outdoor water spray game is known which automatically ejects water on a player if the player fails to activate a manually operable switch according to the rules of the game. This game does not, however, use either playing cards or a game board.

Also, an outdoor board game is known which employs a substantially flat playing surface and has an ejecting device secured to the center of the playing surface. However, even this known game does not employ the element of playing cards which are utilized to direct the action of a player with a water ejection device to determine how many times another player will be squirted with water thereby providing an unusual, refreshing and exciting game that is especially appealing to children but which may also appeal to adults.

Accordingly, it has been considered desirable to develop a new and improved game which would overcome the foregoing difficulties and others while providing better and more advantageous overall results.

BRIEF SUMMARY OF THE INVENTION

According to the present invention, a water squirting game is provided.

More particularly in accordance with this aspect of the invention, the game comprises a water resistant game board having a playing surface and a water squirting nozzle which is operatively connected to the game board. A first set of water resistant playing cards are provided together with a second set of water resistant playing cards. The second set of playing cards contains an indicium to differentiate the second set from the first set of playing cards.

According to another aspect of the invention, each set of playing cards has thereon a number. The number on the first set of playing cards indicates the number of times a player is to be sprayed with water. The number on the second set of playing cards is utilized for constructing hands to determine which player of a group of players will be the winner.

According to a further aspect of the invention, a method for playing a fluid squirting game is disclosed.

More particularly, in accordance with with this aspect of the invention the game comprises the steps of providing a game board having a playing surface and a squirting nozzle for ejecting water; selecting players and dealing a plurality of cards from a set of playing cards and from a set of water cards to each of the players. The plurality of cards of the set of playing cards is compared between the players. The player with the higher hand wins and becomes the winning player for that round with the other player becoming the losing player. The winning player takes a card from the plurality of water cards of the losing player. Thereupon the winning player squirts the losing player with water the number of times indicated on the water card taken from the losing player.

According to a still further aspect of the invention, the plurality of playing cards is collected, shuffled and redealt to determine the winning player for the next round of the game.

According to a yet further aspect of the invention, after a plurality of rounds of determining the winner and squirting the loser, the winning player for the game is determined. This is done by determining a numerical value of the water cards remaining for each player and declaring as the winner the player having the highest numerical value for his water cards.

One advantage of the present invention is the provision of a new and improved game which proves to be refreshing and entertaining.

Another advantage of the present invention is the provision of a game apparatus which includes a water ejection device for ejecting water onto the players of the game, as determined by the rules of the game.

Still another advantage of the present invention is the provision of a game which employs a water spray nozzle together with a water resistant game board and water resistant playing cards.

Yet another advantage of the present invention is the provision of a water squirting game which employs a game board that is divided into quandrants for the players and which game board includes an outer wall to prevent playing cards used in the game from sliding off the game board when water is sprayed with the nozzle provided with the game.

A further advantage of the present invention is the provision of a game which utilizes two sets of cards, namely, a set of water cards and a set of playing cards. The cards contain first indicia which differentiate the sets of cards from each other and second indicia which differentiate the cards in each of the sets of cards.

A still further advantage of the present invention is the provision of a game which determines the number of times a player is to be sprayed by a set of numbers provided on a respective one of a set of water cards.

A yet further advantage of the present invention is the provision of a game which utilizes a set of playing cards to determine which player will be the winner of a round of the game. That player then chooses a water card from the losing player or players and squirts that player the number of times indicated on the water card chosen.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 1:
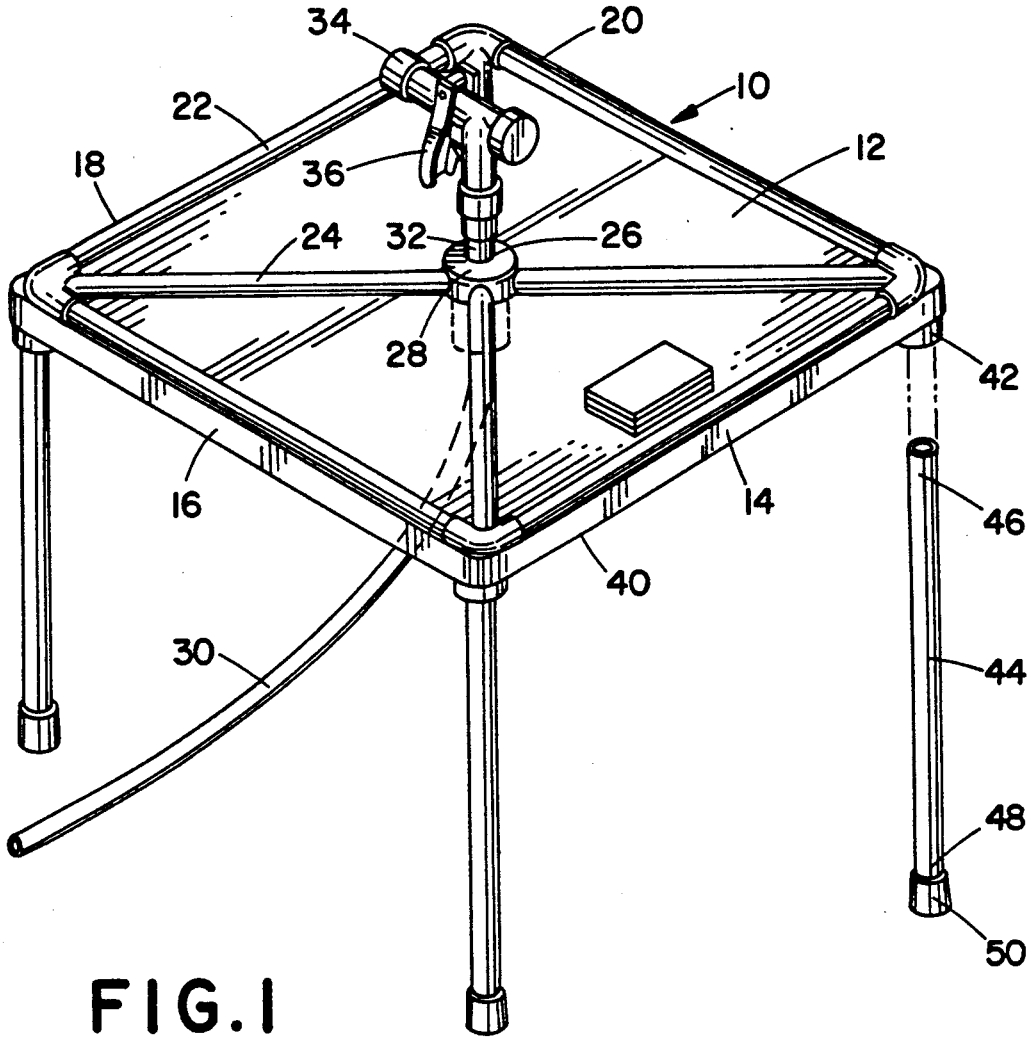
FIG. 1 is a perspective view of a game board and a fluid squirting nozzle according to the present invention.

Referring now to the drawings which are for purposes of disclosing the preferred embodiment of the invention only and not for purposes of limiting same, FIG. 1 discloses a support frame or game board 10 that is used for playing the game. While the frame or board is indicated as being square in shape and as having a central aperture therethrough for accommodating a squirt nozzle, it should be appreciated that other embodiments of both the board and the location of the aperture for accommodating the squirt nozzle therein can also be utilized.

The game board 10 includes a playing surface 12 which is a top surface thereof and a plurality of sides 14, 16, 18 and 20. Preferably four sides are provided and the game board can be square as mentioned. Located atop the playing surface 12, at the outer periphery thereof, is a wall 22 which can be made of suitable tubular members if desired. The wall is advantageous in preventing playing cards which may be placed on the surface 12 from sliding off the playing surface when water is squirted during the game. While the wall 22 is shown as being a separate member which is secured to the playing surface 12 of the game board it should be appreciated that the wall and the game board could be integrally molded together if made from a suitable plastic material. A plastic material for the game board is advantageous in that it resists moisture during the playing of the game.

Extending across the playing surface 12 from corner to corner are a pair of intersecting ribs 24. The ribs are advantageous in dividing the playing surface into quandrants, one for each player. Located approximately at the center of the game board 10, at the intersection of the ribs 24, is a transverse aperture 26 through which extends a sleeve 28. As with the wall 22, the ribs 24 can be made integral with the game board 10 if so desired. It should also be appreciated that while the ribs 24 divide the game board into quandrants, any other geometric configuration by the ribs so as to divide the game board into, e.g., thirds or sixths or the like could also be utilized. The ribs 24 and sleeve 28 are also preferably made from a suitable moisture resistant material, such as a plastic.

Slidably accommodated within the sleeve 28 is a hose 30, such as a conventional garden hose. One end 32 of the hose 30 is provided with a threaded fitting to which is secured a spray nozzle 34. The nozzle is preferably of the type which will squirt water as desired when a trigger 36 is pulled.

Provided along a bottom surface 40 of the game board 10 are a plurality of stubs 42, preferably one at each corner of the game board. Selectively securable to the game board are legs 44 each of which has a first end 46 that can be accommodated within a suitably sized aperture (not visible) within a respective stub 42 and a second end 48 on which is preferably slipped an end cap 50. The cap 50 proves useful in allowing the game board with the legs to be positioned on e.g., a picnic table and prevents the table from being scratched by the game board's legs. The legs 44 prove advantageous in elevating the game board 10 from a subjacent support surface such as, e.g. a lawn on which the players sit. It is evident that the legs are useful in order to be able to lift the spray nozzle 34 in relation to the game board 10 as the hose 30 needs some clearance under the bottom surface 40 of the game board. It would, of course, also be possible to provide the game board with longer stubs 42 which could serve the function of elevating the game board 10 and providing clearance for the hose 30 without having to use the legs 44. On the other hand, it would also be possible to permanently secure the legs 44 in place or even to manufacture the game board 10 with integral legs if so desired.

Figure 2:
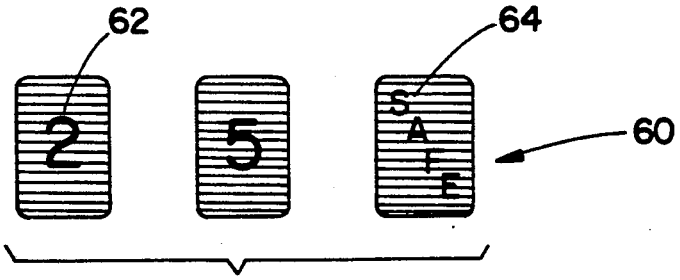
FIG. 2 is a top plan view of several playing cards of a first set of playing cards according to the present invention; and, FIG. 3 is a top plan view of several playing cards of a second set of playing cards according to the present invention.

FIG. 2 illustrates a plurality of water cards 60 which are utilized with the game. The water cards include a number of cards having numerical indicia 62 thereon as well as one "safe" card 64. Preferably twenty-one (21) water cards are provided. There are five cards each that are numbered 2, 3, 4 and 5 on one side thereof and, as mentioned, there is one safe card 64 as well. If desired, the cards can be blue in color, as shown in FIG. 2 which shows the cards lined for the color blue.

Figure 3:
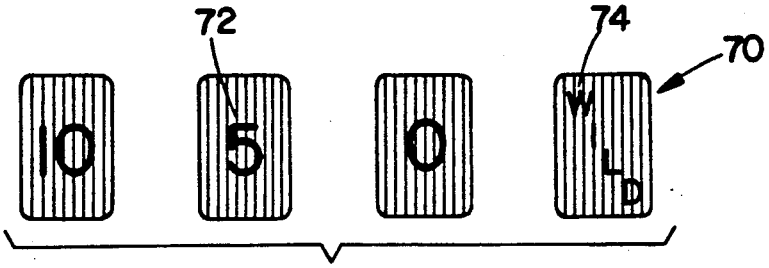

Also utilized in the game are a plurality of game cards 70. Most of these cards have a numerical indicium 72 thereon. However, several of the cards are wild cards as at 74. There are preferably twenty-four (24) playing cards, which are colored red to distinguish them from the water cards (the cards 70 are lined for the color red in FIG. 3). It should be evident, however, that any other colors or other differentiating indicia may be utilized to distinguish the water cards from the playing cards. The playing cards 70 are provided such that there are four tens, four nines, four eights, four sevens, four fives, two zeros and two wild cards. As in normal playing cards, the tens are high. The zeros are the low cards.

Due to the presence of water from the squirt nozzle, it is evident that both the game board 10 and the sets of playing cards 60 and 70 need to be water resistant. Preferably, therefore, the playing cards as well as the game board are made from a suitable conventional plastic material.

There can be from two to four players playing the game and the object of the game is to be the player with the most points after eight hands or card games are played. The players will take turns dealing and each player will, on the initial deal, get five water cards face down. The dealer then deals out three playing cards to each player. The player at the left of the dealer has the first option to play or pass. If the player feels that he has a winning hand, he plays. Whereas if the player feels that his hand is a bad one, he passes. Each player in turn has the same option. The high hand of those electing to play wins. If two players challenge each other, the best hand wins when the players compare their sets of cards with each other. The winner then takes one water card from the loser's set of cards. The winner then grabs a spray nozzle 34 and sprays the loser the number of times indicated by the numeral on the water card taken from the losing player. As is evident, that number can be from two to five.

However, if the winner of the hand picks the "safe" water card from the loser, then things get turned around. The loser would then get a chance to pick a water card from the winner's hand. The loser would then spray the winner the number of times indicated on the water card picked from the winner. The safe card is only used once, however. Therefore, after it has been used once, it is set aside.

If everybody passes on a particular hand, the dealer gets to take one water card from the player of his choice. The dealer then grabs the spray nozzle 34 and sprays that player the number of times shown by the indicium on the water card selected from that player. If all four players challenge each other, then the winner gets to pick one water card from each of the losing players and is able to spray each of the players the number of times indicated on the water card taken from that player.

In the case of ties, players will exchange water cards and spray each other according to the number indicated on the water cards exchanged.

By passing, a player does not lose a water card. However, the player does not gain any points either. For example, if three people play and one person passes, that person does not lose a water card since the winner of the hand would take water cards only from the players who played and lost, then spray them accordingly. However, sooner or later, each player has to play and even take a chance since the player with the most points on his water cards at the end of eight hands wins the game. Therefore, it is desirable to collect water cards from the other players.

After a hand has been played, the game cards 70 are collected from all of the players, shuffled and redealt again such that each player gets three cards. Then the hands are again compared as outlined above. The game goes through eight such deals and comparisons of hands. Thereafter the players count up the points or numbers that they have on their remaining water cards. The player with the largest numerical score wins. The winner of the game gets to squirt the player with the lowest numerical score five times.

If, however, a player loses all of his water cards at some point during the game, i.e. before all eight hands are dealt and played, that player automatically loses the game and can be sprayed, if desired, at that point by the winner, i.e. the player who then has the most points on his water cards.

It has been determined that the game is fast paced such that each complete game of dealing eight hands takes no more than about five minutes or so. It is evident that while the game is directed towards children, it can be played by an entire family such that parents and other grown-ups, who are appropriately attired in swim gear or old clothes, play with children.

The invention has been described with reference to the preferred embodiment. However, one should appreciate that changes and alterations will occur to those of average skill in the art upon a reading and understanding of this specification. It is intended that all such modifications and alterations be included if they come within the scope of the appended claims or the equivalents thereof.

What is claimed is:

1. A game comprising:

a support frame having a playing surface;

a means for ejecting water, said means for ejecting being operatively connected to said support frame;

a first set of playing cards for the game wherein said first set of playing cards comprises a plurality of cards each having thereon a number indicating the number of times a player is to be sprayed with water; and, a second set of playing cards for the game wherein said second set of playing cards comprises a plurality of cards each having thereon a number in the range of 0 to 10.

2. The game of claim 1 further comprising a wall means, secured to said playing surface, for separating said playing surface into sections.

3. The game of claim 1 wherein said means for ejecting comprises a spray gun.

4. The game of claim 1 further comprising a plurality of legs, each secured at one end to said support frame for elevating said playing surface from a subjacent support surface.

5. The game of claim 1 wherein a wall, secured to said playing surface, encircles an outer periphery of said playing surface and extends above same.

6. A water squirting game comprising:

a water-resistant game board having a playing surface;

a water squirting nozzle, said nozzle being operatively connected to said game board;

a first set of water-resistant playing cards for the game wherein said first set of playing cards comprises a plurality of cards each having thereon a number indicating the number of times a player is to be sprayed with water; and, a second set of water-resistant playing cards for the game, wherein said second set of playing cards contains an indicium to differentiate said second set of playing cards from said first set of playing cards, said second set of playing cards being used for determining which player wins a round of the game.

7. The game of claim 6 wherein said second set of playing cards comprises a plurality of cards each having thereon a number in the range of 0 to 10.

8. The game of claim 6 wherein said game board is polygonal in shape so as to provide room for a plurality of players, one for each side of said game board.

9. The game of claim 6 further comprising a sleeve secured to and extending through said game board, said sleeve slidably accommodating a hose secured at one end to said water squirting nozzle.

10. A method of playing a fluid squirting game comprising the steps of:

providing a game board and a squirt nozzle for ejecting water, said nozzle being operatively connected to said game board;

selecting players;

dealing a plurality of cards from a set of playing cards to each of the players;

dealing a plurality of cards from a set of water cards to each of the players;

comparing the plurality of cards of the set of playing cards of at least two players wherein the player having a higher hand wins and becomes the winning player for that round with another player becoming the losing player;

the winning player taking a card from the plurality of water cards of the losing player; and, the winning player squirting the losing player the number of times indicated on the water card taken from the losing player.

11. The method of claim 10 further comprising the steps of:

collecting the plurality of cards from the players;

shuffling the playing cards; and, re-dealing a plurality of playing cards to each of the players.

12. The method of claim 11 further comprising the steps of:

comparing the plurality of playing cards of at least two players wherein the player having a higher hand wins and becomes the winning player for that round with another player becoming the losing player;

the winning player taking a card from the water cards of the losing player; and, the winning player squirting the losing player the number of times indicated on the water card taken from the losing player.

13. The method of claim 12 further comprising the steps of:

determining a numerical value of the water cards for each player;

adding the numerical values of the water cards for each player; and, declaring as the winner the player having the highest of the numerical values.

14. The method of claim 13 further comprising the steps of:

determining which player has the fewest number of points for their water cards; and, the winning player squirting the losing player.

15. The method of claim 10 wherein if during said step of comparing the hands of said first and second players, the hands are of equal value then further comprising the step of exchanging water cards between the two players and subsequently performing said step of squirting wherein each player squirts the other player the number of times indicated on the water cards exchanged.

16. The method of claim 10 wherein said set of water cards also comprises a "safe" card and wherein when said "safe" card is the one chosen by the winning player from the losing player's hand then the losing player gets to squirt the winning player the number of times indicated on a water card that the losing player gets to pick from the winning player's set of water cards.

17. The method of claim 10 wherein a player who loses all of his water cards automatically loses the game.

* * * * *